United States Patent [19]

Esaki

[11] Patent Number: 4,554,856

[45] Date of Patent: Nov. 26, 1985

[54] MUSIC BOX WITH INDICATOR HOIST MECHANISM

[75] Inventor: Hiroshi Esaki, Tokyo, Japan

[73] Assignee: Kunio Kasai, Tokyo, Fed. Rep. of Germany

[21] Appl. No.: 586,123

[22] Filed: Mar. 5, 1984

[30] Foreign Application Priority Data

Jun. 1, 1983 [JP] Japan ..... 58-081872

[51] Int. Cl.[4] ..... G10F 1/06

[52] U.S. Cl. ..... 84/95 C

[58] Field of Search ..... 84/95 C, 94 C; 446/397, 446/476, 490; D17/24; D21/64

[56] References Cited

U.S. PATENT DOCUMENTS 2,705,387 4/1955 Handler et al. ..... 84/94 C X 3,535,819 10/1970 Spilhaus ..... 446/397 X

FOREIGN PATENT DOCUMENTS 1072860 9/1954 France ..... 84/95 C

*Primary Examiner*—L. T. Hix

*Assistant Examiner*—Brian W. Brown

*Attorney, Agent, or Firm*—Lowe, King, Price & Becker

[57] ABSTRACT

Provided is a music box capable of simultaneously playing music and hoisting an indicator, wherein a pole extends upright from a housing, a pulley is mounted on a shaft interlocked with a rotating member having projections opposing a vibrating plate disposed in the housing, one end of a string connected to a flag is fixed to the pulley and is wound therearound, and the other end of the string is also fixed to the pulley through a top of the pole.

8 Claims, 3 Drawing Figures

MUSIC BOX WITH INDICATOR HOIST MECHANISM

BACKGROUND OF THE INVENTION

The present invention relates to a music box in which music is played and an indicator, for example, an animal toy or doll is simultaneously hoisted.

Conventionally, a music box in which music is played and a doll or an animal toy is simultaneously turned, and a music box which has a house-like shape, are known.

SUMMARY OF THE INVENTION

It is a first object of the present invention to provide a new music box which simultaneously provides music performance and indicator hoisting.

It is a second object of the present invention to provide a music box in which a string is smoothly moved to hoist an indicator.

It is a third object of the present invention to provide a music box in which music performance is interrupted simultaneously when indicator hoisting is stopped at a desired position.

In order to achieve the above and other objects of the present invention, there is provided a music box with an indicator hoist mechanism, wherein a pole extends upright from a housing, a pulley is mounted on a shaft which is interlocked with a rotating member comprising a drum which has projections opposing a vibration plate disposed in said housing, one end of a string connected to an indicator is fixed to said pulley and is wound along one of two grooves formed in said pulley, and the other end of said string is also fixed to said pulley along the other groove thereof through a top of said pole, a stopping piece is mounted on a portion of said string which is located outside said housing, a stopper is inserted/withdrawn with respect to a rotating track of a blade rotated together with said rotating member, and a rotating shaft of said stopper extends upward.

DETAILED DESCRIPTION OF THE INVENTION

Figure 1:
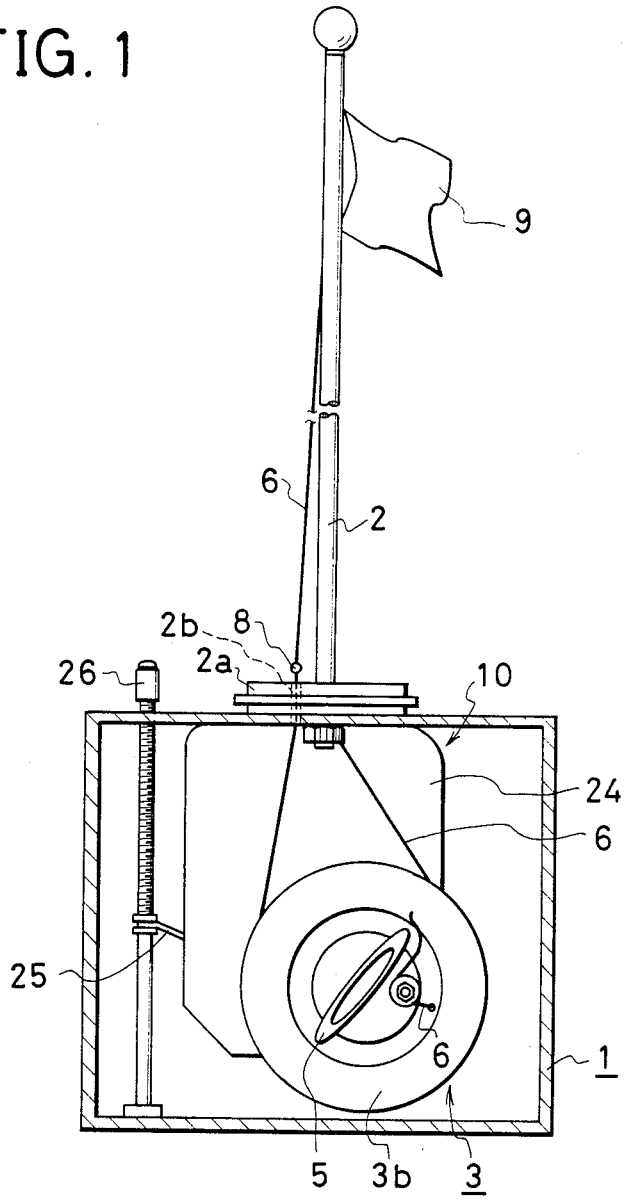
FIG. 1 is a front sectional view showing an embodiment of music box with a flag hoist mechanism according to the present invention.
Figure 3:
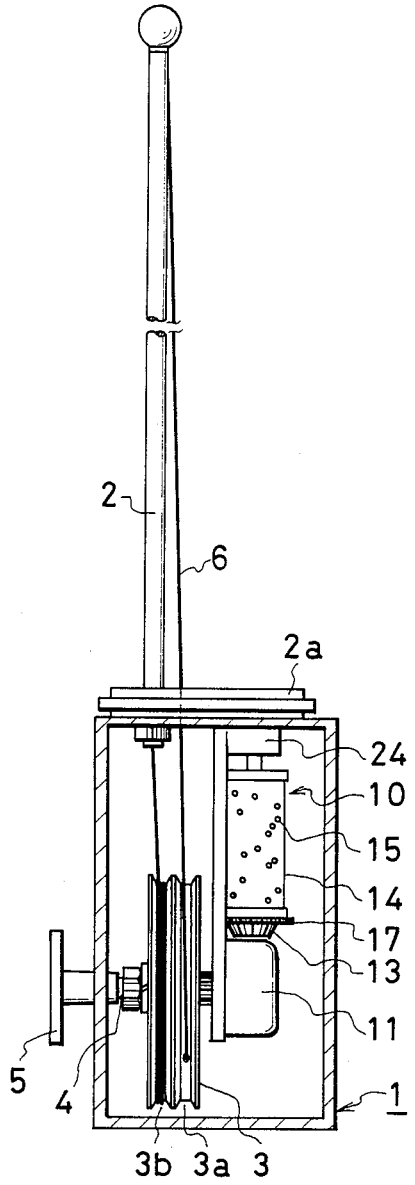
FIG. 3 is a right side sectional view wherein a flag is omitted.

Referring to FIG. 1, a pole 2 extends upright from an upper portion of a housing 1. Two through holes 2*b* are formed in a pole stand 2*a* which is disposed at the base of the pole 2, and a string 6 (to be described later), securing a flag 9 which is a kind of an indicator thereon, can be vertically moved in the through holes 2*b*. A pulley 3 and a winding member 5 are mounted on a shaft 4 which is supported by a bracket 24 in the housing 1. As shown in FIG. 3, the pulley 3 has grooves 3*a* and 3*b*, and the distal end of the string 6 is fixed at a bottom surface portion of the groove 3*a*. When the winding member 5 is fully wound, about half of the string 6 is wound along the groove 3*a* of the pulley 3. The remaining portion of the string 6 is guided outside the housing 1 through one of the through holes 2*b*. The string 6 is passed through a string guide hole 7 formed at the top of the pole 2, and is turned downward and inserted in the other through hole 2*b*. The string 6 is wound along the groove 3*b* of the pulley 3 through half of its circumferential length. Then the leading end of the string 6 is fixed at a bottom surface portion of the groove 3*b*. A lead stop ball 8 is connected to the string 6.

Figure 2:
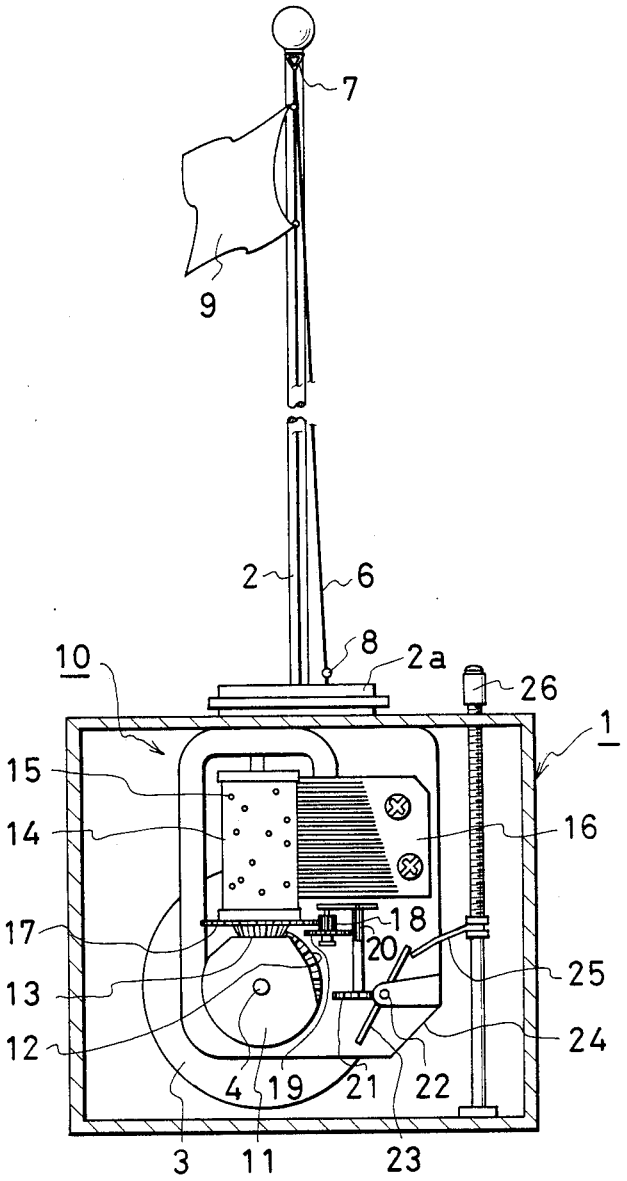
FIG. 2 is a rear sectional view thereof.

As shown in FIG. 2, a music playing member 10 is mounted on the bracket 24. One end of a power spring is fixed on the shaft 4 provided with the winding member 5, and the other end thereof is fixed on a power spring case 11. A bevel gear 12 is mounted on the shaft 4, such that the gear 12 rotates through a one way clutch (not shown) only in the direction toward which the power spring held within the case 11 is unwound. A bevel gear 13 is mounted on the lower portion of a drum 14 of music playing member 10, and meshes with the bevel gear 12. A plurality of projections 15 extend radially on the outer surface of the drum 14 and face the edge of a vibration plate 16 in the housing 1. As drum 14 turns, individual ones of projections 15 intermittently engage portions of the edge of vibration plate 16 which has cuts (see FIG. 2) causing it to act as a set of reeds or bars whose motion after engagement by projections 15 generates a series of musical notes. The housing 1, which contains drum 14, projections 15 and vibration plate 16 forms a music box.

A gear 17 is mounted together with the bevel gear 13, and its rotation is transmitted to gears 18, 19, 20 and 21 in the order named. The rotation of the drum 14 interlocks with the shaft 4. A blade 23 is mounted at the distal end of a shaft 22 which has a worm (not shown) meshing with the gear 21. A stopper 25 for stopping the rotation of the blade 23 is fixed on a stopper pivot shaft. The stopper pivot shaft is rotatably mounted in the housing 1, and has a knob 26 at the upper distal end thereof.

When the winding member 5 is wound by a hand, the shaft 4 and the pulley 3 are rotated in a predetermined direction so that about half of the string 6 is wound along the groove 3*a* of the pulley 3, and the power spring is biased upon rotation of the shaft 4. Meanwhile, the rotation of the shaft 4 is not transmitted to the bevel gear 13 due to the presence of the one way clutch. When the hand winding the winding member 5 is released, the bevel gear 12 and the shaft 4 are rotated by the biasing force of the power spring through the one way clutch, and the string 6 is wound along the groove 3*b* upon rotation of the pulley 3. The rotation of the bevel gear 12 is transmitted to the bevel gear 13 so as to rotate the drum 14. Therefore, the projections 15 flip the small bars of the vibration plate 16 such that a melody is produced since each of the small bars has different length to produce a different tone. The gear 17 is coaxially mounted on the bevel gear 13, and the rotation of the gear 17 is transmitted to the gears 18, 19, 20 and 21 in sequence. The gear 21 meshes with a worm (not shown) such that the blade 23 mounted on the worm shaft 22 is rotated at a high speed. Upon high-speed rotation of the blade 23, the rotating speed of the drum 14 is kept constant. When the pulley 3 continues to rotate, the portion of the string 6 which is wound on the bottom surface portion of the groove 3*a* is released and moved upward, so that the flag 9 connected to the string 6 is hoisted as an indicator to the top of the pole 2. When the upper end of the flag 9 reaches the top of the pole 2, the lead stop ball 8 of the string 6 is fitted in the through hole 2*b*, stopping flag hoisting and music performance.

When the winding member 5 is wound again, the pulley 3 is rotated again. The string 6 wound on the bottom surface portion of the groove 3*b* is released and raised, and then wound along the bottom surface portion of the groove 3*a*. Consequently, the flag 9 connected to the string 9 is moved downward. During this operation, even though the shaft 4 is rotated, the bevel gear 12 is not rotated due to the presence of the one way clutch. Therefore, the drum 14 is not rotated, resulting in no music performance.

When the knob 26 is rotated so as to insert the stopper 25 to the rotating track of the blade 23, the rotation of the blade 23 can be stopped, temporarily stopping hoisting of the flag 9 and the music performance of the music playing member 10 at a desired height.

According to the present invention, it is preferred that the indicator is associated with the music. Especially, if a national flag and the corresponding national anthem are used together, the music box receives a great deal of attention as, for example, an international conference or an international trade exhibition.

What is claimed is:

1. A music box with an indicator hoist mechanism, comprising:

a housing of said music box;

an upright pole attached to extend upright from said housing;

a powered rotatable shaft supported substantially within and by said housing;

a pulley mounted on and rotatable with said shaft;

a string extending from said pulley, through an opening in said housing to an upper portion of said pole;

a rotating member provided with surface projections;

gear means for coupling together said shaft and said rotating member;

a vibration plate, portions of which are intermittently engaged by said projections as said rotating member rotates; and an indicator attached to said string externally of said housing and moving with said string during rotation of said pulley.

2. A music box according to claim 1 wherein:

said rotating member is a drum.

3. A music box according to claim 1, further comprising:

a stop member attached to said string externally of said housing, said stop member being sized to be larger than said opening.

4. A music box according to claim 1 wherein:

said rotatable shaft is powered by a rewindable spring between said shaft and said housing.

5. A music box according to claim 1, further comprising:

speed control means for controlling the speed at which said rotating shaft rotates.

6. A music box according to claim 1 wherein:

said shaft engages said gearing through a one-way rotating clutch.

7. A music box according to claim 1, further comprising:

shaft rotation stopping means, having a portion thereof accessible from the outside of said housing, for stopping the rotation of said rotating shaft at a predetermined time.

8. A music box according to claim 1, wherein:

said projections and said vibration plate cooperate to play musical notes representative of a country's national anthem; and said indicator is a flag of said country.

* * * * *